United States Patent [19]

Hutchins et al.

[11] 4,132,172

[45] Jan. 2, 1979

[54] HINGED BRIDGING PLUG FOR EXPLOSIVE PLACEMENT HOLES

[75] Inventors: Ned M. Hutchins, Grand Junction; J. Walter Enyeart, Grand Valley; Leon G. Holbrook, Silt, all of Colo.

[73] Assignee: Occidental Oil Shale, Inc., Grand Junction, Colo.

[21] Appl. No.: 787,013

[22] Filed: Apr. 13, 1977

[51] Int. Cl.[2] ..... F42B 3/20

[52] U.S. Cl. ..... 102/30; 102/21.8; 166/192

[58] Field of Search ..... 102/21.8, 21.2, 20, 102/30; 166/192, 202, 117, 214, 135

[56] References Cited

U.S. PATENT DOCUMENTS

| | | | |
|---|---|---|---|
| 615,321 | 12/1898 | Straub et al. | 102/21.8 X |
| 1,979,802 | 11/1934 | Kinley | 102/20 UX |
| 2,047,774 | 7/1936 | Greene | 102/21.2 |
| 2,053,448 | 9/1936 | Starr | 166/192 X |
| 2,710,065 | 6/1955 | Hamilton | 166/117 |
| 2,808,890 | 10/1957 | Clark et al. | 166/192 |
| 3,756,316 | 9/1973 | Van Ruth | 166/202 X |

*Primary Examiner*—David H. Brown

*Attorney, Agent, or Firm*—Christie, Parker & Hale

[57] ABSTRACT

A bridging plug for a circular blast hole has a relatively longer major axis and a relatively shorter minor axis. The plug is hinged to pivot about the minor axis. A tension line is secured to the minor axis for lowering the plug into an explosive placement hole. The plug pivots into an angular open position when lowered into the hole. An upward force on the tension line jams the hinged portions of the plug in a closed position to plug the hole. An explosive charge can be placed in the hole at the location defined by the closed plug.

28 Claims, 5 Drawing Figures

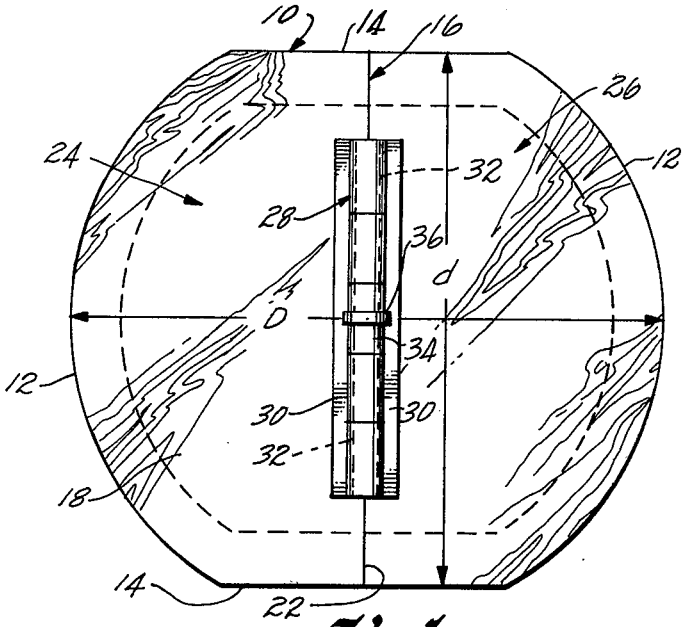
Fig. 1
Fig. 3
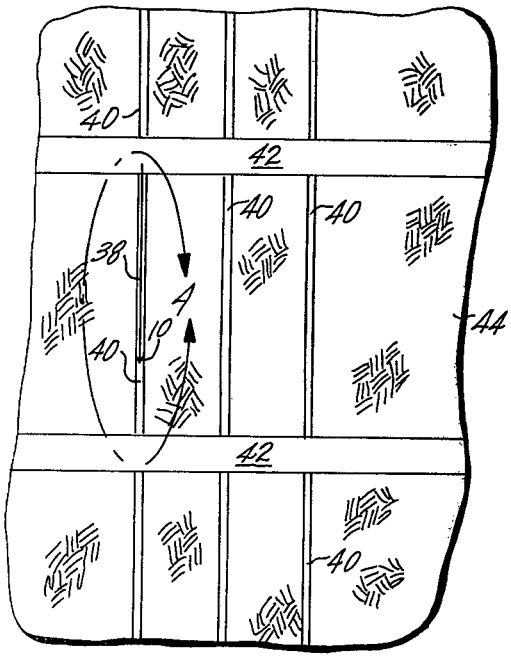
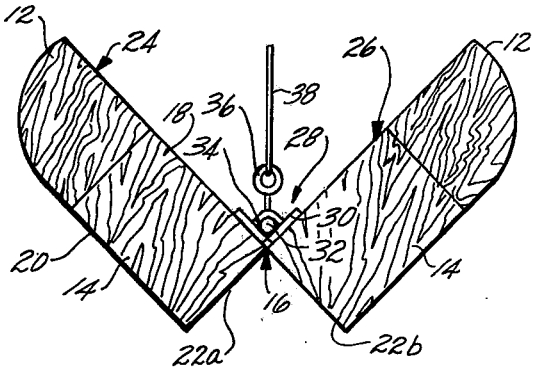
Fig. 2

HINGED BRIDGING PLUG FOR EXPLOSIVE PLACEMENT HOLES

BACKGROUND

This invention relates to bridging plugs for plugging holes in underground formations. More particularly, the invention relates to a bridging plug for closing off a bore hole in preparation for placing an explosive charge in the hole. The present invention is particularly applicable to, but not necessarily limited to, the art of in situ retorting of oil shale.

In mining operations, such as in situ retorting of oil shale, it is often desirable to place explosive charges at desired locations in the oil shale deposit. For example, an in situ oil shale retort is commonly formed by initially removing oil shale from certain portions of the deposit to form vertically spaced apart void volumes or rooms. Explosive charges are then dispersed throughout the portions of the deposit between the rooms, after which these portions are explosively expanded to fill the retort with fragmented oil shale particles.

Explosive charges are placed in relatively small-diameter explosive placement holes, commonly called "blast holes", which extend a relatively long distance through the oil shale deposit. Blast holes are commonly in the range of between about 3¾ inches to 10⅞ inches in diameter; and they extend some times as much as several hundred feet through the formation. Inasmuch as an oil shale formation is a relatively impermeable rock mass, these relatively long blast holes are of relatively uniform diameter from top to bottom.

There are various situations in which it is desirable to plug the lower portion of a blast hole and then place an explosive charge in the plugged hole. For example, blast holes are often drilled downwardly from the floor of an upper room through the ceiling of a lower room below the upper room. The blast holes are then plugged to hold an explosive charge in the bottom of the blast hole, especially if the explosive agent is a free flowing explosive such as ammonium nitrate and fuel oil (ANFO).

As a further example, it is often desirable to place explosive charges at selected elevations throughout a formation in order to control the explosive expansion of the deposit. Placement of explosive charges at selected elevations can be accomplished efficiently by drilling the blast holes and then plugging the holes at the desired elevations prior to placing the explosive charges in the plugged holes.

Blast holes also are plugged at locations selected to ensure that water soluble explosives, such as ANFO, do not come into appreciable contact with water-bearing portions of a deposit.

In the past, there have been disclosed a number of bridging plugs for plugging the bottoms of holes drilled in underground formations. The following patents illustrate such bridging plugs:

| U.S. Pat. No. | Patentee |
|---|---|
| 1,092,540 | Robinson |
| 2,047,774 | Greene |
| 2,253,224 | Bleakley |
| 2,710,065 | Hamilton, Jr. |
| 3,039,534 | Koop |
| 3,126,827 | McReynolds, Jr. |
| 3,170,516 | Holland et al |
| 3,593,785 | Bassani |

-continued

| U.S. Pat. No. | Patentee |
|---|---|
| 3,674,088 | Ovelson |

The bridging plugs disclosed in these patents are generally complex in structure and relatively expensive to manufacture when compared with the present invention. As a result, they are not practical for uses involving large scale blasting operations, such as those used in forming an in situ oil shale retort. Moreover, the complex structures of the bridging plugs disclosed in these patents make them relatively difficult, if not impossible, to use in the narrow-diameter blast holes commonly used in in situ retorting of oil shale.

The present invention overcomes these disadvantages by providing a relatively simple, but highly effective, hinged bridging plug which is especially useful in plugging the bottoms of relatively small diameter blast holes.

SUMMARY OF THE INVENTION

Briefly, the present invention, according to a presently preferred embodiment, includes a bridging plug body shaped to conform generally to the contour of an explosive placement hole, for example. The body has a major axis longer than the diameter of the placement hole and a minor axis substantially equal to the diameter of the placement hole. The body is divided into a pair of opposed foldable segments hinged to pivot relative to one another substantially about the minor axis. Means are provided for lowering the hinged plug body into the explosive placement hole. Outer portions of the segments located on the major axis of the plug engage the walls of the hole to cause the plug segments to pivot into an open position as the plug is lowered. An upward force applied to the hinged portion of the plug pivots the hinged segments into a closed position, jamming the plug in the hole to close off the lower portion of the hole.

These and other aspects of the invention will be more fully understood by referring to the detailed description and the accompanying drawings.

BRIEF DESCRIPTION OF THE DRAWINGS

FIG. 1 is a top plan view showing a hinged bridging plug according to principles of this invention;

FIG. 2 is a fragmentary side elevation view showing the bridging plug of FIG. 1 in a hinged open position;

FIG. 3 is a fragmentary cross-sectional elevation view illustrating the use of the bridging plug in an in situ oil shale retort;

DETAILED DESCRIPTION

Figure 4:
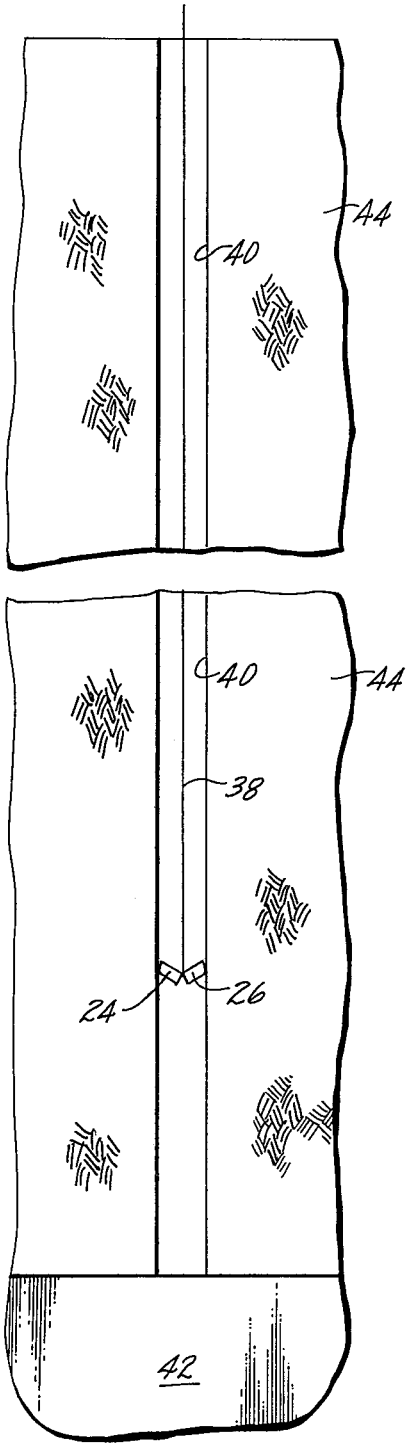
FIG. 4 is an enlarged fragmentary cross-sectional elevation view illustrating the bridging plug in a hinged open position during lowering of the bridging plug in an explosive placement hole shown within the circle 4 of FIG. 3.

Referring to FIGS. 1 and 2, a hinged bridging plug, according to a presently preferred embodiment of this invention, includes a plug body 10 which, in plan view, has circularly curved opposed outer edges 12 extending around a major portion of the periphery of the plug body. A pair of elongated, parallel, generally flat edges 14 are formed along opposite sides of the plug and define a remaining minor portion of the periphery of the plug body.

The plug is constructed from an initially circularly-shaped body (when viewed in plan view, as in FIG. 1) in which diametrically opposed portions of the body are relieved to form the flat edges 14. Thus, the distance between the circularly curved outer edges 12 (represented by D in FIG. 1) is greater than the distance between the flat edges 14 (represented by *d* in FIG. 1). The flat edges 14 are of substantially equal length and define a minor axis 16 of the plug body. The curved outer edges 12 define a major axis (represented by reference line D in FIG. 1) extending perpendicularly to the minor axis 16.

The plug body, thus, has a generally elliptical configuration, in that it has a relatively longer major axis and a relatively shorter minor axis perpendicular to the major axis. Although the periphery of the presently preferred plug is defined by a combination of circularly curved outer edges on the major axis and flat edges on the minor axis, the plug body also can be more truly elliptical in configuration, as will be apparent from the description below, without departing from the scope of the invention.

The plug body has a generally flat top surface 18 and a substantially parallel, flat bottom surface 20. A linear split 22 extends depthwise from the top surface to the bottom surface along the minor axis 16 to divide the body into foldable halves or segments 24 and 26. The split 22 forms a pair of abutting inner edges 22*a* and 22*b* extending along the minor axis 16 of the plug body. The curved outer edges 12 and the flat edges 14 taper narrower from the top surface 18 to the bottom surface 20.

The segments 24 and 26 are pivotally attached to one another by a hinge 28 secured to the top surface 18 of the plug body along the minor axis 16. The hinge 28 is of conventional construction and can be any means for allowing the segments 24 and 26 to pivot freely about the minor axis or hinge axis 16 between a generally planar closed position and an angular open position, in which the hinge axis 16 is lower than the curved outer edges 12 of the plug segments, as illustrated in FIG. 2.

Preferably, the hinge 28 has a pair of base portions 30 secured by suitable fasteners (not shown) to the plug halves 24, 26 along opposite sides of the split 22. The hinge joint is formed by a pair of collinear pivot pins 32 disposed in a sleeve formed by opposed knuckles 34 of the hinge. The inner ends of the pivot pins 32 are spaced apart by a short distance at the center of the minor axis 16 to provide access for an upright eye-bolt 36 secured to the center knuckle of the hinge.

A long cable or tension line 38 is secured to the eye of the eye-bolt 36. Thus the cable 38 is attached to the plug at a location relatively nearer the hinge axis than the outer edges of the halves of the plug. Preferably, the tension line is attached at a location on the plane defined by the hinge axis of the plug. Alternately, a pair of eye-bolts can be secured to the outer knuckles of the hinge 28, substantially in line with the hinge axis 16, and a single pivot pin can be located in the space between the eye-bolts. In this instance, a yoke (not shown) can be formed at the lower portion of the tension line 38 and secured to the pair of eye-bolts.

Figure 5:
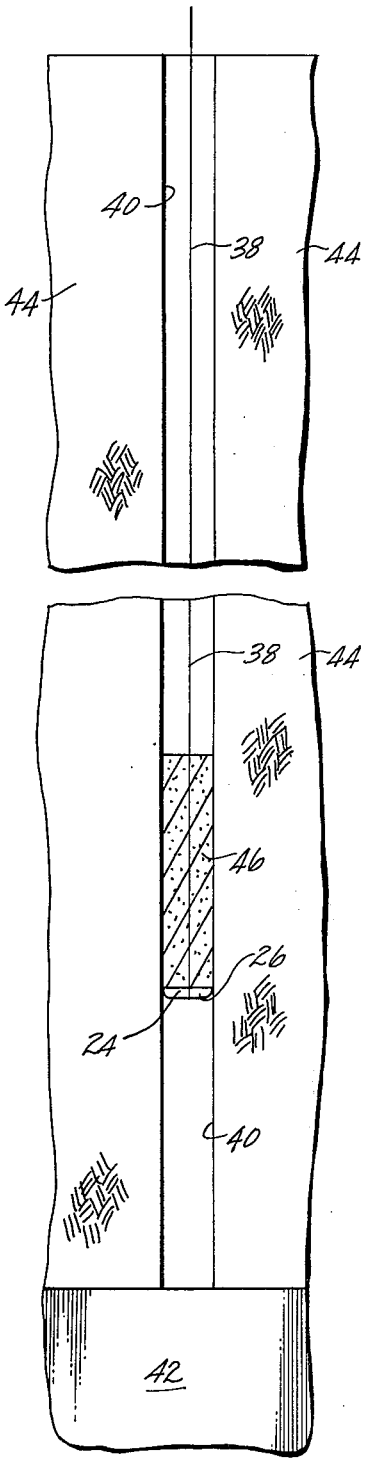
FIG. 5 is a fragmentary cross-sectional elevation view showing the hinged bridging plug of FIG. 4 in a hinged closed position with an explosive charge resting on the closed bridging plug.

FIGS. 3 through 5 illustrate the use of the hinged bridging plug 10 in a hole drilled in an underground mine. The preferred use of the bridging plug is to close off a lower portion of a blast hole drilled in a rock face of a mining tunnel or void volume by conventional drilling equipment. By way of illustration only, the hinged bridging plug is shown closing off the bottom of a blast hole 40 drilled downwardly from a void volume or room 42 in a section of an in situ retort formed in a subterranean oil shale deposit 44. As described above, in situ retorting of oil shale involves drilling a great many blast holes 40 between one room and another in the oil shale deposit. There are many instances when it is desirable to plug a lower portion of a blast hole, such as (1) to place explosive charges at selected vertical locations in the deposit, (2) to avoid contact between an explosive placement and a water-bearing portion of the underground formation, or (3) to hold a free running explosive agent, such as ANFO, in a lower portion of a blast hole which otherwise opens through a ceiling of a lower void volume.

The hinged bridging plug 10 is used by attaching the tension line 38 to the eye-bolt 36 and then lowering the bridging plug into the blast hole 40, as illustrated in FIG. 4. The bridging plug is lowered until it reaches the desired depth which can be measured by the length of tension line payed out. The cross-sectional dimension of the blast hole 40 can be within a broad range. For example, blast holes commonly used in oil shale mining are between about 3¾ inches to about 10⅞ inches in diameter, as defined by the diameter of conventional rock drilling bits used in the industry. The dimensions of the bridging plug 10, as viewed in plan view, will vary in accordance with the diameter of the blast hole to be bridged. The major axis of the bridging plug, according to this invention, has a length D (see FIG. 1) which is sightly longer than the diameter of the blast hole. The length *d* of the minor axis 16 of the bridging plug is substantially equal to the diameter of the blast hole, having a clearance which is sufficient to allow the bridging plug to be lowered freely into the blast hole (without causing appreciable loss of explosive once the bridged blast hole is filled with explosive). By way of example, the major axis of the bridging plug 10 has a length D of about 3⅞ inches when used in a 3¾ inch diameter blast hole. The minor axis 16 has a length *d* of about 3½ inches.

As the bridging plug is lowered, the curved outer edges 12 of the plug halves contact the walls of the blast hole 40. This causes the plug halves to pivot downwardly about the hinge axis 16 so that the plug travels downwardly in an angular hinged open position, with the apex of the plug being relatively nearer the lower portion of the blast hole. Thus, the plug halves pivot open solely by their contact with the walls of the blast hole, independently of the tension in the tension line, for example.

When the plug reaches its desired position in the blast hole, an upward pulling force is applied to the tension line 38 in a direction opposite to that in which the plug is lowered. This upward force pulls the plug halves 24 and 26 into a relatively planar, closed position in the blast hole. Inasmuch as the plug halves are oversized with respect to the diameter of the blast hole, and the tension line 38 is attached to the hinge axis 16 at a location relatively lower than the points of contact between the plug halves and the walls of the hole 40, the upward force on the tension line pivots the plug halves into the closed position solely by the upward force on the tension line and the frictional contact between the outer edges 12 of the plug and the walls of the hole. The plug segments and lying substantially in the plane of the top surface for pivoting the segments about said minor axis.

15. A bridging plug according to claim 14 in which the segments have opposed outer edges spaced from said minor axis and extending transversely to said major axis, and in which the outer edges of the segments taper narrower from the top surface to the bottom surface.

16. A bridging plug according to claim 11 in which the body is made from a non-metallic material.

17. A bridging plug according to claim 16 in which the body is made from a relatively rigid material.

18. A bridging plug according to claim 17 in which the segments pivot into said closed position solely by frictional contact between the outer edges thereof and the walls of the hole in response to said pulling force being applied to said minor axis by the tension line means.

19. A bridging plug according to claim 11 including means securing the tension line to the body to allow the segments to move freely relative to each other independently of tension in the tension line.

20. A bridging plug according to claim 19 including eye-bolt means carried by the hinge means for attaching the tension line to the body.

21. A bridging plug according to claim 20 in which the body has a top surface spaced above a bottom surface thereof, and the hinge means are secured to the segments and lie substantially in the plane of the top surface.

22. A bridging plug according to claim 19 in which the body has a top surface spaced above a bottom surface thereof, and the hinge means are secured to the segments and lie substantially in the plane of the top surface.

23. A bridging plug according to claim 22 in which the segments have opposed outer edges spaced from said minor axis and extending transversely to said major axis, and in which the outer edges of the segments taper narrower from the top surface to the bottom surface.

24. A bridging plug for a circular explosive placement hole comprising:

a generally elliptical body separated into a pair of opposed segments foldable about a transverse hinge axis, the body having a major axis transverse to the hinge axis, the breadth of the body along the major axis being greater than the breadth of the body along the hinge axis;

means securing the segments together for allowing each segment to pivot freely about the hinge axis independently of the other segment; and means connected adjacent the hinge axis for lowering the bridging plug in an explosive placement hole and for applying an upward force adjacent the hinge axis which, in cooperation with frictional contact between the segments and the walls of the holes, pivots the segments about the hinge axis jamming the bridging plug in the explosive placement hole.

25. A bridging plug according to claim 24 in which the means for lowering the bridging plug and for applying said upward force includes a tension line secured adjacent the hinge axis, the segments being freely movable relative to one another independently of the tension in the tension line.

26. A bridging plug according to claim 24 in which the means for securing the segments allows the segments to pivot into a substantially V-shaped orientation in response to frictional contact with the walls of the hole, and in which the segments are movable to a substantially planar position in response to said upward force.

27. A bridging plug according to claim 24 in which the means for securing the segments allows the segments to pivot between a relatively angular open position and a relatively planar closed position; and in which the means for securing the segments allows the segments to pivot to an open position when the bridging plug is lowered in the explosive placement hole, and in which the means for applying the upward force pivots the segments through the means for securing the segments toward the closed position.

28. A bridging plug according to claim 27 in which the means for lowering the bridging plug and for applying said upward force includes a tension line secured adjacent the hinge axis, the segments being freely movable relative to one another independently of the tension in the tension line.

* * * * * halves 24 and 26, being oversized with respect to the blast hole, cause the plug to be jammed in the blast hole 40 in response to the upward force, thereby plugging the bottom of the hole.

An explosive charge 46, such as ANFO, then can be placed on top of the bridging plug. The tension line is left taut to maintain the bridging plug in its jammed position in the blast hole and prevent it from being accidentally displaced by the weight of explosive in the hole.

The body 10 of the bridging plug can be made from a rigid material; but preferably the bridging plug is made from a semi-rigid, non-metallic material, preferably wood, which is somewhat pressure deformable, and thereby aids in jamming the plug in the blast hole in response to the upward force applied to the tension line 38.

The tension line 38 can be a detonating cord for use in detonating the explosive held by the bridging plug as well as providing means for applying tension to the plug.

Several of the bridging plugs can be used for separating a long column charge of explosive into a number of smaller vertically spaced apart separate column charges. For example, it can be desirable to separate a slurry-type explosive into a number of smaller sections to avoid undue compression at the bottom of a long column which otherwise can inhibit detonation. Multiple bridging plugs also can be used in deck-loading of an explosive placement hole, in which the explosive charge is separated by the plugs into vertically spaced levels. The levels are then detonated at different times using time-delay detonating techniques.

In instances where several bridging plugs are used to separate a long column of explosive into vertically spaced levels, a passage can extend through at least one of the halves in each bridging plug to provide passage for detonating cord(s) or cap wire(s) extending upwardly from any bridging plug(s) located below the plug. The passage is sufficiently small to prevent appreciable flow of explosive material through the plug. Alternately, the wire can simply pass the edge of upper plugs in the hole.

Thus, the invention provides a bridging plug which is relatively simple and inexpensive in construction, and also is relatively simple in function and operation, being highly effective in relatively quickly and easily closing off blast holes at desired locations within the holes. The relatively simple construction of the bridging plug makes the plug especially suitable for use in blast holes of relatively smaller diameter, say 3¾ inch diameter blast holes, as well as being highly adaptable to being made in a number of different sizes and configurations to conform to holes of different sizes.

What is claimed is:

1. A bridging plug for closing an explosive placement hole comprising:

a body separated into a pair of opposed segments foldable about a transverse hinge axis;

hinge means securing the segments together for allowing the segments to pivot about said hinge axis;

the body having generally opposed outer edges remote from said hinge axis lying substantially on a major axis of the body, said major axis being longer than the hinge axis; and means for lowering the body into an explosive placement hole, the hinge means allowing the segments to pivot about said hinge axis into an open position by contact between said outer edges of the body and the walls of the hole, and for applying a pulling force to the body to pivot the segments into a closed position in response to frictional contact between the outer edges of the segments and the walls of the hole, the segments in said closed position being jammed in a fixed position in the hole.

2. A bridging plug according to claim 1 in which the lowering means includes tension line means secured to the plug relatively nearer to the hinge axis than to said outer edges of the body.

3. A bridging plug according to claim 1 in which the major axis is substantially perpendicular to the hinge axis.

4. A bridging plug according to claim 1 in which the lowering means includes tension line means secured to the body, the segments being freely movable independently of the tension in the tension line.

5. A bridging plug according to claim 4 including means securing the tension line to a location on the body substantially on said hinge axis.

6. A bridging plug according to claim 1 in which the body is made of a non-metallic material.

7. A bridging plug according to claim 6 in which the body is made from a semi-rigid material.

8. A bridging plug according to claim 1 in which the body has a top surface spaced above a bottom surface thereof; said hinge means being secured to the segments and lying substantially in the plane of the top surface for pivoting the segments about said hinge axis.

9. A bridging plug according to claim 8 including tension line means secured to the hinged segments for applying said pulling force to the segments near the hinge axis from a location above the top surface of the body.

10. A bridging plug according to claim 8 in which said outer edges of the segments taper narrower from the top surface to the bottom surface of the body.

11. A bridging plug for closing an explosive placement hole comprising:

a substantially elliptical-shaped body having a relatively longer major axis and a relatively shorter minor axis;

means dividing the body along said minor axis into a pair of opposed segments;

hinge means for pivoting the segments about said minor axis, the hinge means allowing the segments to pivot between a relatively angular open position and a relatively planar closed position; and tension line means secured to the hinged body at a location substantially on said minor axis for lowering the bridging plug body into an explosive placement hole in said open position and for applying a pulling force to pivot the segments through said hinge means toward said closed position.

12. A bridging plug according to claim 11 in which the major axis is substantially perpendicular to the minor axis.

13. A bridging plug according to claim 11 in which the segments have opposed outer edges spaced from said minor axis and extending transversely to said major axis, and in which the body is dimensioned so that the segments pivot to said open position solely by contact between the outer edges thereof and the walls of the hole during lowering of the body into the hole.

14. A bridging plug according to claim 11 in which the body has a top surface spaced above a bottom surface thereof; said hinge means being secured to the